US010008813B2

(12) United States Patent
Nozawa et al.

(10) Patent No.: US 10,008,813 B2
(45) Date of Patent: Jun. 26, 2018

(54) ELECTRONIC DEVICE

(71) Applicant: Sony Interactive Entertainment Inc., Tokyo (JP)

(72) Inventors: Tetsufumi Nozawa, Chiba (JP); Minoru Wakabayashi, Tokyo (JP)

(73) Assignee: Sony Interactive Entertainment Inc., Tokyo (JP)

( * ) Notice: Subject to any disclaimer, the term of this patent is extended or adjusted under 35 U.S.C. 154(b) by 0 days. days.

(21) Appl. No.: 15/465,878

(22) Filed: Mar. 22, 2017

(65) Prior Publication Data

US 2017/0294745 A1 Oct. 12, 2017

(30) Foreign Application Priority Data

Apr. 7, 2016 (JP) ..... 2016-077160

(51) Int. Cl.
*H01R 9/03* (2006.01)
*H01R 13/6596* (2011.01)
*H01R 13/6591* (2011.01)

(52) U.S. Cl.
CPC ..... *H01R 13/6596* (2013.01); *H01R 13/6591* (2013.01)

(58) Field of Classification Search
CPC ..... H01R 13/6591; H01R 13/6596
USPC ..... 439/607.17–607.19
See application file for complete search history.

(56) References Cited

U.S. PATENT DOCUMENTS 5,735,712 A 4/1998 Haas
6,276,963 B1 * 8/2001 Avery ..... H01R 13/518 439/541.5
6,283,791 B1 9/2001 Tai
6,729,905 B1 * 5/2004 Hwang ..... H01R 13/65802 439/607.21
7,029,331 B1 * 4/2006 Lai ..... H01R 13/65802 439/607.35
7,530,845 B1 5/2009 Yang
7,632,145 B1 12/2009 Lin
2002/0196616 A1 12/2002 Horng
2015/0064969 A1 3/2015 Kao

FOREIGN PATENT DOCUMENTS

EP 1793457 A2 6/2007
JP 2007-299620 A 11/2007
JP 3172262 U 11/2011

OTHER PUBLICATIONS

Extended European Search Report for corresponding EP Application No. 17162769.8, 8 pages, dated Aug. 31, 2017.
Office Action for corresponding JP Application No. 2016-077160, 15 pages, dated Jan. 16, 2018.

* cited by examiner

*Primary Examiner* — Khiem Nguyen
(74) *Attorney, Agent, or Firm* — Matthew B. Dernier, Esq.

(57) ABSTRACT

Disclosed herein is an electronic device including: a connector configured to connect to another electronic device via a wired communication link; and a reference member whose potential is maintained at a constant level, wherein the connector includes a housing which houses connection terminals therein, and an electrically conductive protrusion joined to at least a distal end portion of the housing, the electrically conductive protrusion including at least a portion which is elastic, and electrically connected to the reference member.

7 Claims, 4 Drawing Sheets

ELECTRONIC DEVICE

BACKGROUND

The present disclosure relates to a connector for connecting to another electronic device via a wired communication link, and an electronic device provided with such a connector.

Various communication interfaces have been used to interconnect electronic devices via a wired communication link. They include communication interfaces such as universal serial bus (USB) 3.0, high-definition multimedia interface (HDMI) (registered trademark), etc. which send and receive signals at a relatively high clock frequency for realizing high-speed communications.

SUMMARY

Electronic devices which send and receive signals at a high clock frequency tend to produce high-frequency noise. In particular, in case such an electronic device itself also performs wireless communication by way of wireless local area network (LAN) or Bluetooth (registered trademark) or there is another electronic device that performs wireless communication close by, the noise produced by wired communications may adversely affect the quality of wireless communications.

The present disclosure has been made in view of the above problems. It is desirable to provide a connector and an electronic device which are capable of effectively reducing noise produced by wired communications.

According to an aspect of the present disclosure, there is provided an electronic device including a connector configured to connect to another electronic device via a wired communication link, and a reference member whose potential is maintained at a constant level, wherein the connector includes a housing which houses connection terminals therein, and an electrically conductive protrusion joined to at least a distal end portion of the housing, the electrically conductive protrusion including at least a portion which is elastic, and electrically connected to the reference member.

According to another aspect of the present disclosure, there is provided a connector for being housed in an electronic device having a reference member whose potential is kept at a constant level, and for connecting to another electronic device via a wired communication link, including a housing which houses connection terminals therein, and an electrically conductive protrusion joined to at least a distal end portion of the housing, the electrically conductive protrusion including at least a portion which is elastic, and electrically connected to the reference member.

DETAILED DESCRIPTION OF THE PREFERRED EMBODIMENTS

Embodiments of the present disclosure will be described in detail below with reference to the drawings.

An electronic device 1 according to an embodiment of the present disclosure may be a personal computer, a game machine for home use, a portable game machine, or the like, for example, and is provided with a connector 10 for connecting to another electronic device via a wired communication link. Specifically, it is assumed that the electronic device 1 includes a USB host device whereas the connector 10 includes a USB receptacle or socket into which a USB plug compatible with the USB 3.0 standards can be inserted. The other electronic device, which is assumed to be a USB device herein, to be connected to the connector 10 of the electronic device 1 will hereinafter be referred to as "destination device." The destination device may be connected to the connector 10 either directly or via a USB cable, a USB hub, or the like.

Figure 1:
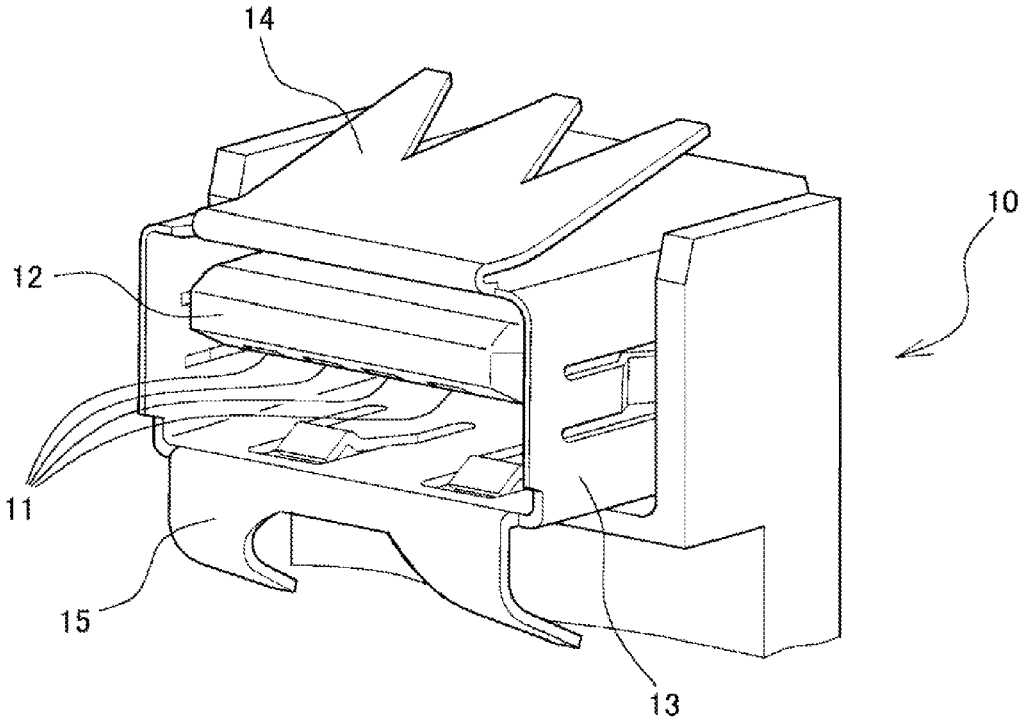
FIG. 1 is a perspective view of a connector for use in an electronic device according to an embodiment of the present disclosure.
Figure 2:
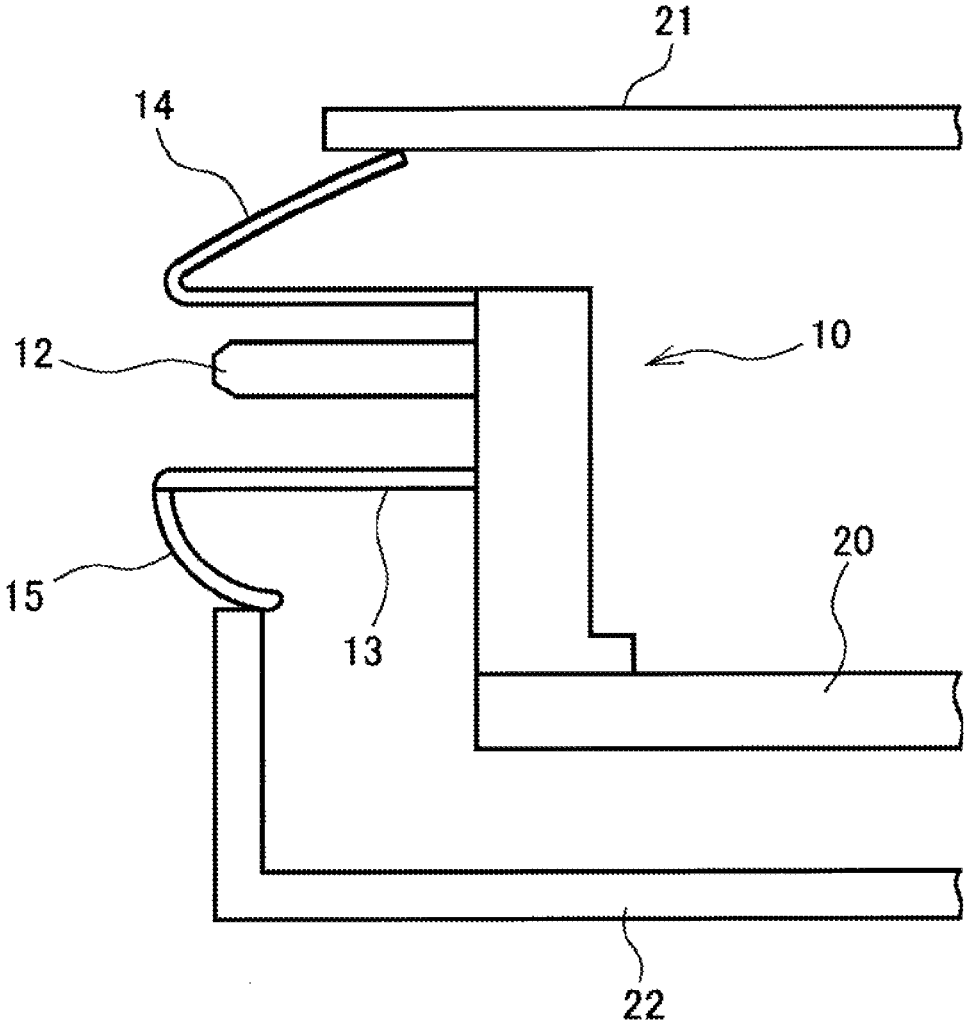
FIG. 2 is a schematic view of the connector that is disposed in the electronic device according to the embodiment.

FIG. 1 depicts in perspective view the connector 10, and FIG. 2 schematically depicts the connector 10 that is disposed in the electronic device 1, illustrating the positional relationship between the connector 10 and other parts as viewed in side elevation. As depicted in FIG. 1, the connector 10 includes a plurality of connection terminals 11, a base 12, a housing 13, a first protrusion 14, and a second protrusion 15. As depicted in FIG. 2, the connector 10 is mounted on a board 20.

The connection terminals 11 are fixed to the base 12. The electronic device 1 performs data communication with the destination device by sending differential signals to and receiving differential signals from the destination device through signal terminals among the connection terminals 11.

The housing 13, which includes a tubular case made of electrically conductive sheet metal, houses the connection terminals 11 and the base 12 therein to protect them. The housing 13 is of a rectangular shape as views in front elevation according to the USB standards. For connecting the destination device to the electronic device 1, the USB plug is inserted into the housing 13.

The inventors of the present application have found, as a result of their research, that one of major emission sources of the noise produced by communications via the connector 10 is the distal end portion of the housing 13, i.e., an outwardly opening portion of the casing of the electronic device 1. According to the present embodiment, the first protrusion 14 and the second protrusion 15 are joined to the distal end portion of the housing 13 for reducing the emission of the noise therefrom. Specifically, each of the first protrusion 14 and the second protrusion 15 includes an electrically conductive member and has an end electrically connected to a reference member. The first protrusion 14 and the second protrusion 15 thus arranged reduce the emission of the noise from the distal end portion of the housing 13.

The reference member includes an electrically conductive member whose potential is maintained at a constant level. The reference member may be a chassis or frame housing therein the board 20 that supports thereon electronic circuits in the electronic device 1 or a noise prevention shield member, i.e., may be a metal member functioning as a frame ground of the electronic device 1. According to the present embodiment, as depicted in FIG. 2, an upper shield member 21 and a lower shield member 22 are disposed in confronting relation to both surfaces of the board 20 in order to block the noise emitted from electronic parts disposed on the board 20. These shield members function as reference members. Specifically, the first protrusion 14 is disposed in contact with the upper shield member 21, whereas the second protrusion 15 is disposed in contact with the lower shield member 22. The potential (reference potential) of the reference members may be the same as, or different from, the ground potential of the electronic circuits on the board 20 or the potential of a ground terminal of the connector 10. The upper shield member 21 and the lower shield member 22 may be kept at the same potential or different potentials. Although the first protrusion 14 and the second protrusion 15 have been described as being electrically connected to the different reference members, they may be electrically connected to the same reference member.

The first protrusion 14 is made of electrically conductive metal and is joined to an upper side of the distal end portion of the housing 13. More specifically, as depicted in FIG. 1, the first protrusion 14 and the housing 13 are integrally made of a single metal sheet, which is folded back upwardly at the distal end of the housing 13 to provide the first protrusion 14 that extends obliquely back from the distal end portion of the housing 13. The first protrusion 14 and the upper surface of the housing 13 form an acute angle therebetween as viewed in side elevation, and include respective portions that overlap or face each other, as viewed in plan.

The first protrusion 14 serves as an elastic metal spring which generates a repulsive force when a force from above, i.e., a force directed toward the housing 13, is applied thereto by the upper shield member 21. The distal end portion of the first protrusion 14 contacting the upper shield member 21 is pressed against the upper shield member 21 by the generated repulsive force, so that the first protrusion 14 is reliably electrically connected to the upper shield member 21. Since the first protrusion 14 is elastic, it does not distort the housing 13 out of shape when a force is applied from the upper shield member 21 to the first protrusion 14. If the housing 13 is distorted out of shape, it would be difficult to insert the USB plug into the connector 10. According to the present embodiment, the first protrusion 14 is partly or wholly made of an elastic material, so that the rigidity of the first protrusion 14 against a force from above, i.e., a force directed toward the housing 13, is smaller than the rigidity of the housing 13. Therefore, when a force from above is applied to the first protrusion 14 by the upper shield member 21, the first protrusion 14 is elastically deformed to absorb the applied force, preventing the housing 13 from being deformed.

In order to reduce the emission of noise from the housing 13, it is desirable to shorten as much as possible the electric pathway between the housing 13 and the upper shield member 21 via the first protrusion 14. It is also desirable that the first protrusion 14 be electrically connected to the upper shield member 21 reliably through as wide a contact area as possible. According to the present embodiment, the first protrusion 14 has substantially the same width as the base 12 where the first protrusion 14 is joined to the housing 13, and is joined to the upper side, substantially in its entirety, of the distal end portion of the housing 13. The first protrusion 14 has such a shape that it is branched into a plurality of fingers toward its distal end. Inasmuch as the fingers have respective distal end portions held in contact with the upper shield member 21, the contact area is made wider than if the first protrusion 14 contacts the upper shield member 21 through one point.

As with the first protrusion 14, the second protrusion 15 serves as an electrically conductive, elastic metal spring. The second protrusion 15 is joined to a lower side, opposite the upper side to which the first protrusion 14 is joined, of the distal end portion of the housing 13. More specifically, as depicted in FIG. 1, the second protrusion 15 and the housing 13 are integrally made of a single metal sheet, which is folded back downwardly at the distal end of the housing 13 to provide the second protrusion 15 that extends obliquely back from the distal end portion of the housing 13. The second protrusion 15 includes two fingers extending downwardly from the right and left ends of the lower side of the distal end portion of the housing 13. These two fingers have respective distal end portions held in contact with the lower shield member 22. The second protrusion 15 generates a repulsive force under spring elasticity when a force from below is applied thereto by the lower shield member 22. The distal end portion of the second protrusion 15 is pressed against the lower shield member 22 by the generated repulsive force, so that the second protrusion 15 is electrically connected to the lower shield member 22. The second protrusion 15 is effective to reduce the emission of noise from the lower side of the housing 13. Since the rigidity of the second protrusion 15 against a force from below is smaller than the rigidity of the housing 13, the housing 13 is not deformed when a force is applied from the lower shield member 22.

As described above, the electronic device 1 according to the present embodiment is arranged such that the electrically conductive protrusions which project from the distal end portion of the housing 13 outwardly from the housing 13 are held in contact with the reference members to reduce the emission of noise from the connector 10. The emission of noise is effectively reduced by the protrusions that are provided on both the upper and lower sides of the distal end portion of the housing 13.

The present disclosure is not limited to the embodiment described above. In the foregoing description, the protrusions are provided on the housing 13 of the connector (receptacle) 10 compatible with the USB 3.0 standards. However, similar protrusions may be provided on the housings of receptacles compatible with various standards such as HDMI, for example.

The protrusions provided on the connector 10 are not limited to the structures and shapes described above. Some modifications of the structures of the protrusions joined to the housing 13 will be described below.

Figure 3:
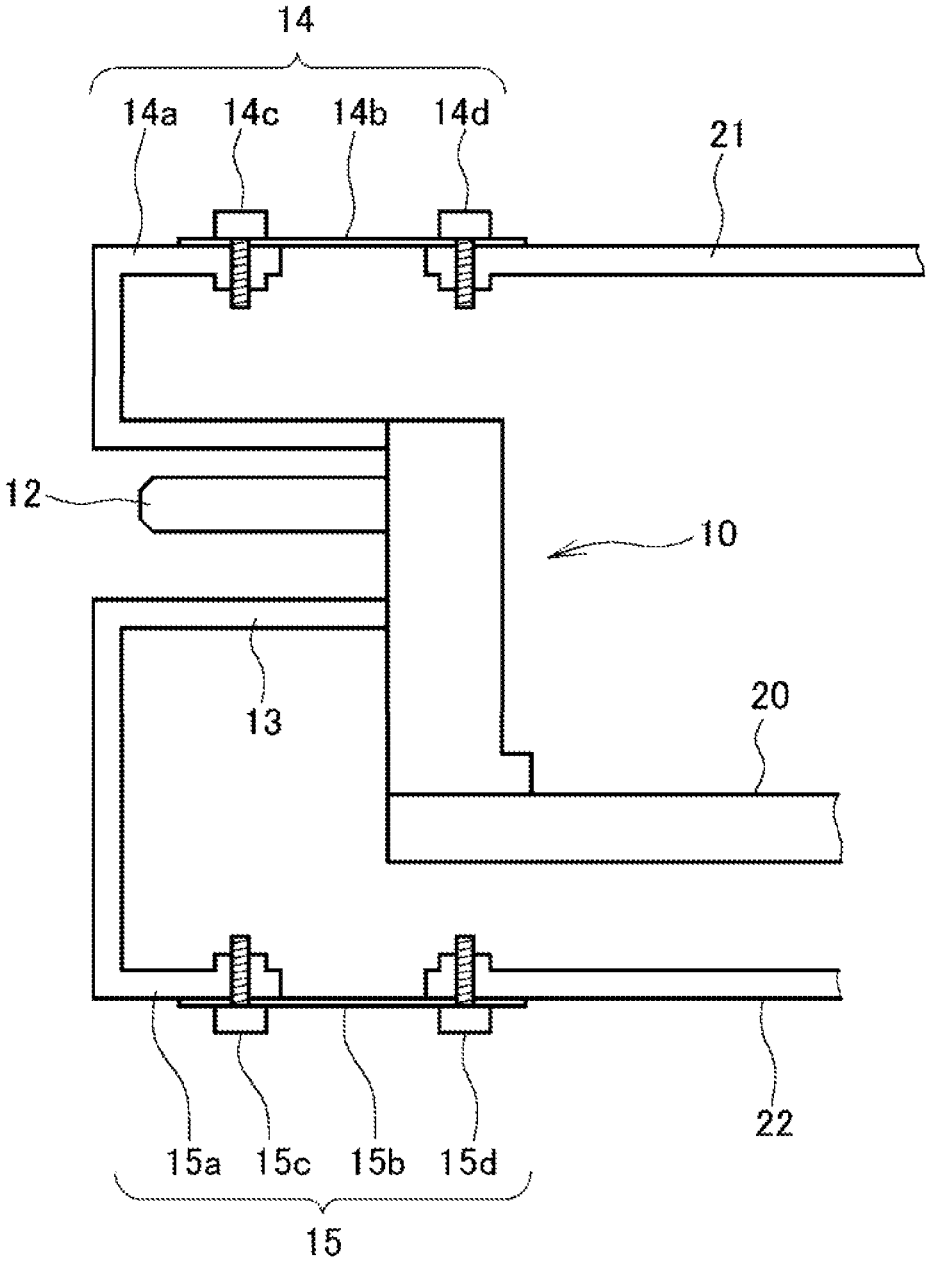
FIG. 3 is a schematic view of a connector that is disposed in an electronic device according to a first modification.

A first modification will be described below with reference to FIG. 3. FIG. 3 is a schematic view depicting the shape of a connector 10 and the positional relationship between the connector 10 and other parts, in a manner similar to FIG. 2. According to the present modification, each of protrusions projecting upwardly and downwardly from the housing 13 includes a metal member integrally formed with the housing 13 and another separate metal member.

Specifically, a first protrusion 14 includes a first member **14*a* integrally formed with the housing 13 and a separate second member 14*b*. The first member 14*a* includes a portion extending upwardly, i.e., in a direction perpendicular to the upper surface of the housing 13, from the upper side of the distal end portion of the housing 13, and a portion bent rearwardly, i.e., back into the casing of the electronic device 1, at the upper end of the upwardly extending portion. The second member 14*b* lies parallel to the upper surface of the housing 13, and is joined to the first member 14*a* by a screw 14*c* at a front position thereon, i.e., near the face side of the casing of the electronic device 1. The second member 14*b* is also joined to the upper shield member 21 by a screw 14*d* at a rear position thereon. The second member 14*b* may instead be joined to the first member 14*a* and the upper shield member 21** by various methods such as by crimping rivets, for example, rather than the screws.

According to the present modification, the second member 14*b* includes a metal sheet thinner than the first member 14*a* and the housing 13. Therefore, the rigidity of the second member 14*b* is smaller than the rigidity of the first member 14*a* and the housing 13, making the second member 14*b* function as an elastic member. Even when various parts change in size and position, the second member 14*b* is elastically deformed to absorb the changes, preventing the housing 13 from being deformed.

As with the first protrusion 14, a second protrusion 15 includes a first member 15*a* integrally formed with the housing 13 and a separate second member 15*b*. The first member 15*a* includes a portion extending downwardly from the lower side of the distal end portion of the housing 13, and a portion bent rearwardly at the lower end of the downwardly extending portion. The second member 15*b* lies parallel to the lower surface of the housing 13, and is joined to the first member 15*a* by a screw 15*c* at a front position thereon. The second member 15*b* is also joined to the lower shield member 22 by a screw 15*d* at a rear position thereon. The second member 15*b* may also instead be joined to the first member 15*a* and the lower shield member 22 by various methods rather than the screws. As with the second member 14*b*, the second member 15*b* includes a metal sheet thinner than the housing 13 and the first member 15*a*, and hence functions as an elastic member. Therefore, even though the second protrusion 15 is joined to the lower shield member 22, it prevents the housing 13 from being deformed.

In FIG. 3, both the first protrusion 14 on the upper side and the second protrusion 15 on the lower side include separate members. However, only either one of the two protrusions depicted in FIG. 2 may be replaced with the structure according to the modification depicted in FIG. 3.

Figure 4:
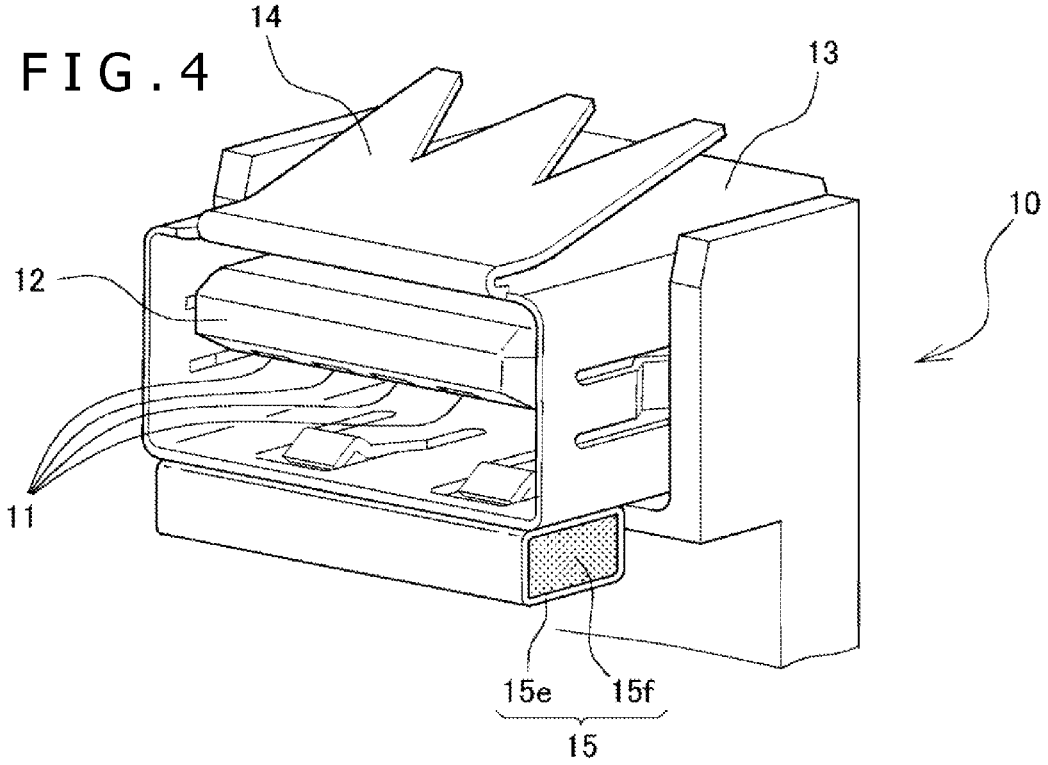
FIG. 4 is a perspective view of a connector for use in an electronic device according to a second modification.
Figure 5:
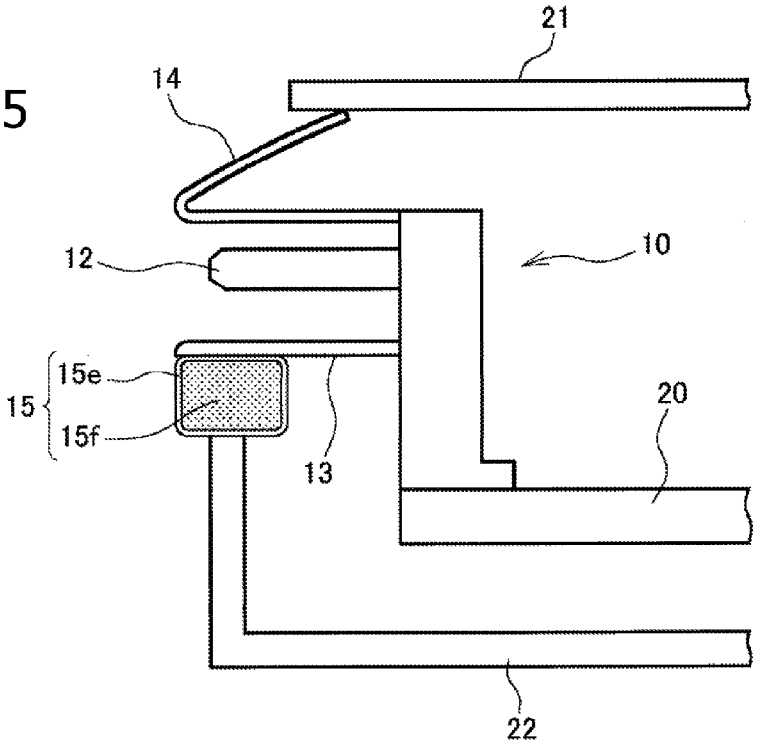
FIG. 5 is a schematic view of the connector that is disposed in the electronic device according to the second modification.

A second modification will be described below with reference to FIGS. 4 and 5. FIG. 4 is a perspective view depicting the appearance of a connector 10 according to the second modification. FIG. 5 is a schematic view depicting the shape of the connector 10 and the positional relationship between the connector 10 and other parts according to the second modification, in a manner similar to FIG. 2. According to the present modification, the structure and shape of a second protrusion 15 projecting downwardly from the housing 13 are different from those depicted in FIGS. 1 and 2.

According to the present modification, the second protrusion 15 includes members separate from the housing 13, and is bonded to the lower surface of the housing 13 which includes the lower side of the distal end portion thereof. Specifically, the second protrusion 15 is a gasket made up of an electrically conductive sponge 15*f* covered with an electrically conductive cloth 15*e*. With this structure, the second protrusion 15 has electrical conductivity and elasticity as a whole. According to the present modification, a lower shield member 22 has a side wall rising from its end near the connector 10 and having an upper end held in contact with the lower surface of the second protrusion 15.

In FIGS. 4 and 5, the gasket is used as the second protrusion 15 on the lower side. However, the first protrusion 14 on the upper side may be a gasket, or both the protrusions on the upper and lower sides may be gaskets.

The protrusions according to the modifications described above may be combined with each other. For example, either one of the two protrusions depicted in FIG. 2 may include the plurality of members depicted in FIG. 3, whereas the other may include the gasket depicted in FIGS. 4 and 5.

The protrusions are not limited to those described above, but may be of various shapes and structures insofar as they are joined to at least the distal end portion of the housing 13 and electrically connected to the reference members. In the above description, there are provided two protrusions joined to the upper and lower sides, which face each other, of the distal end portion of the housing 13. However, a protrusion may be provided on either one of the upper and lower sides of the distal end portion of the housing 13. In addition to or instead of the protrusions joined to the upper and lower sides, there may be provided protrusions joined to the left and right sides of the distal end portion of the housing 13 and electrically connected to the reference members. In the above description, each of the protrusions is rendered elastic by being constructed as a metal spring, an electrically conductive sponge, or the like. However, a suspension or the like may be used to absorb a force applied from a reference member for thereby preventing the housing 13 from being deformed.

The present disclosure contains subject matter related to that disclosed in Japanese Priority Patent Application JP 2016-077160 filed in the Japan Patent Office on Apr. 7, 2016, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electronic device comprising:

a connector configured to connect to another electronic device via a wired communication link; and a reference member having a potential that is maintained at a constant level, wherein said connector includes a housing having an upper side and a lower side, spaced away from the upper side, which define a space within which connection terminals are disposed, and an electrically conductive protrusion joined to at least a distal end portion of said housing, said electrically conductive protrusion including: (i) at least one of a first edge joined to, and spanning an entirety of, the upper side of the housing, and second edge joined to, and spanning an entirety of, the lower side of the housing; (ii) at least one distal edge having a shape that branches into a plurality of fingers; and (iii) that the plurality of fingers are elastic, and electrically connected to said reference member.

2. The electronic device according to claim 1, wherein said electrically conductive protrusion comprises a metal spring.

3. The electronic device according to claim 2, wherein said electrically conductive protrusion comprises a metal member integrally formed with said housing and extending from the distal end portion of said housing, said metal member being of a shape folded back outwardly from said housing.

4. The electronic device according to claim 1, wherein said electrically conductive protrusion comprises an elastic and electrically conductive sponge.

5. The electronic device according to claim 1, wherein said electrically conductive protrusion comprises a first metal member integrally formed with said housing and a second metal member separate from said first metal member, said second metal member being thinner than said first metal member.

6. The electronic device according to claim 1, wherein said electrically conductive protrusion includes:

a first protrusion having the first edge joined to, and spanning an entirety of, the upper side of the housing;

a second protrusion having the second edge joined to, and spanning an entirety of, the lower side of the housing; and said second protrusion being electrically connected to a member whose potential is kept at a constant level.

7. A connector for being housed in an electronic device having a reference member whose potential is kept at a constant level, and for connecting to another electronic device via a wired communication link, comprising:

a housing having an upper side and a lower side, spaced away from the upper side, which define a space within which connection terminals are disposed, and an electrically conductive protrusion joined to at least a distal end portion of said housing, said electrically conductive protrusion including: (i) at least one of a first edge joined to, and spanning an entirety of, the upper side of the housing, and second edge joined to, and spanning an entirety of, the lower side of the housing; (ii) at least one distal edge having a shape that branches into a plurality of fingers; and (iii) that the plurality of fingers are elastic, and electrically connected to said reference member.

* * * * *